US008628359B2

(12) United States Patent
Yokoyama et al.

(10) Patent No.: US 8,628,359 B2
(45) Date of Patent: Jan. 14, 2014

(54) CONNECTOR AND CONNECTOR UNIT

(75) Inventors: Yohei Yokoyama, Tokyo (JP); Takayoshi Oyake, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 139 days.

(21) Appl. No.: 13/245,919

(22) Filed: Sep. 27, 2011

(65) Prior Publication Data

US 2012/0135625 A1 May 31, 2012

(30) Foreign Application Priority Data

Nov. 25, 2010 (JP) ..... 2010-262401

(51) Int. Cl.
*H01R 24/00* (2011.01)

(52) U.S. Cl.
USPC ..... 439/675; 439/901

(58) Field of Classification Search
USPC ..... 439/848, 901, 675, 578, 607.41, 439/607.35, 607.01–607.59
See application file for complete search history.

(56) References Cited

U.S. PATENT DOCUMENTS 2,712,117 A * 6/1955 Stinson ..... 439/160
3,793,616 A * 2/1974 Moehrke ..... 439/854
6,305,984 B1 10/2001 Katoh et al.
6,682,257 B1 * 1/2004 Zappe ..... 404/25
7,445,001 B2 * 11/2008 Sikora ..... 123/634
2001/0049224 A1 12/2001 Togashi et al.

FOREIGN PATENT DOCUMENTS

| | | |
|---|---|---|
| JP | S62-114173 U | 7/1987 |
| JP | S64-19277 U | 1/1989 |
| JP | 2000-357550 | 12/2000 |
| JP | 2001-319741 | 11/2001 |
| JP | 2005-347103 | 12/2005 |
| JP | 2007-323865 | 12/2007 |

OTHER PUBLICATIONS

Japanese Office Action dated Aug. 1, 2012 in Japanese Patent Application No. 2010-262401 along with an English translation of same.

* cited by examiner

*Primary Examiner* — Phuong Dinh
(74) *Attorney, Agent, or Firm* — Collard & Roe, P.C.

(57) ABSTRACT

A connector includes a contact and a shell. The shell includes a tubular shell body portion having a slit portion formed to extend over its entire region in a connector insertion direction, an insertion opening formed at one end of the shell body portion, a locking portion provided on the inner periphery side of the shell body portion, and a shell joining portion formed at a position more on the forward side of the connector insertion direction than a position of the locking portion and joining together opposed portions of the shell body portion divided by the slit portion.

7 Claims, 10 Drawing Sheets

CONNECTOR AND CONNECTOR UNIT

This application is based upon and claims the benefit of priority from Japanese Patent Application No. 2010-262401, filed on Nov. 25, 2010, the disclosure of which is incorporated herein in its entirety by reference.

TECHNICAL FIELD

This invention relates to a connector and a connector unit and, in particular, relates to a coaxial connector and a coaxial connector unit.

BACKGROUND ART

Conventionally, as shown in FIG. 10, there is known a coaxial connector 500 comprising a center conductor 510 and a tubular housing 520 disposed around the center conductor 510 (see, e.g. JP-A-2007-323865 (Patent Document 1)). The housing 520 has an inner periphery formed with a convex portion 521*m* which is adapted to engage with convex portions 623 formed on an outer periphery of a tubular portion 621 of a coaxial adapter 600 which is adapted to be inserted into the coaxial connector 500. The tubular portion 621 of the coaxial adapter 600 is formed with a plurality of slits 622. Upon inserting the coaxial adapter 600 into the coaxial connector 500, the convex portions 623 of the tubular portion 621 abut against the convex portion 521*m* of the housing 520 so that the diameter of the tubular portion 621 is reduced. Then, as the coaxial adapter 600 is further pushed forward, the convex portions 623 of the tubular portion 621 ride over the convex portion 521*m* of the housing 520 so that the tubular portion 621 is elastically restored to increase its diameter. As a consequence, the convex portions 623 of the tubular portion 621 and the convex portion 521*m* of the housing 520 engage each other so that the coaxial adapter 600 is prevented from coming off the coaxial connector 500.

SUMMARY OF THE INVENTION

However, the technique described in Patent Document 1 has a problem that the life of insertion and removal between the coaxial connector 500 and the coaxial adapter 600 is short.

This invention is intended to solve the above-mentioned conventional problem, that is, it is an object of this invention to provide a connector and a connector unit that can improve the life of insertion and removal between the connectors.

According to an exemplary aspect of the present invention, there is provided a connector comprising a contact and a shell disposed around the contact, wherein the shell comprises: a tubular shell body portion having a slit portion formed to extend over its entire region in a connector insertion direction; an insertion opening formed at one end of the shell body portion; a locking portion provided on an inner periphery side of the shell body portion; and a shell joining portion formed at a position more on a forward side of the connector insertion direction than a position of the locking portion and joining together opposed portions of the shell body portion divided by the slit portion.

The locking portion may be a stepped portion which is formed on an inner periphery of the shell body portion and which is inclined in a direction from the inner periphery side to an outer periphery side of the shell body portion from a rearward side of the connector insertion direction toward the forward side of the connector insertion direction.

The shell further may comprise a shell folded-back portion formed by folding back an end portion, on an insertion opening side, of the shell body portion to an outer periphery side of the shell body portion toward the forward side of the connector insertion direction.

The shell further may comprise a mounting projecting portion formed at a position more on the forward side of the connector insertion direction than the position of the locking portion and projecting outward from an outer periphery of the shell body portion.

The shell body portion may have a circular tubular shape.

According to another exemplary aspect of the present invention, there is provided a connector unit comprising the aforementioned connector and a mating connector adapted to be attached to the connector, wherein the mating connector comprises: a mating contact; and a mating shell disposed around the mating contact, and wherein the mating shell comprises: a tubular portion; and a front end side convex portion formed on a front end side of the tubular portion and projecting outward from an outer periphery of the tubular portion.

The front end side convex portion of the mating connector may be locked by the locking portion of the connector, when the mating connector is attached to the connector.

The term "tubular" referred to in this invention is not limited to a tubular shape with a circular cross section, but includes, for example, a tubular shape with a rectangular cross section or a polygonal cross section.

The term "outer periphery" referred to in this invention represents a periphery along the outside of an object while "inner periphery" referred to in this invention represents a periphery along the inside of an object, wherein the shape of the object is not limited to a shape with a circular cross section.

In this invention, by giving elasticity or springiness in terms of the shape to the shell body portion on its insertion opening side, when inserting the mating connector into the connector, the shell body portion is elastically deformed to increase its diameter on the insertion opening side and, therefore, the mating connector can be smoothly inserted into the connector and thus the life of insertion and removal between the connector and the mating connector can be improved.

The shell body portion can be formed by bending a metal plate and thus it is possible to achieve elasticity or springiness also in terms of the material and to reduce the cost.

DESCRIPTION OF THE EMBODIMENTS

Hereinbelow, a connector unit according to an embodiment of this invention will be described with reference to the drawings.

Figure 1:
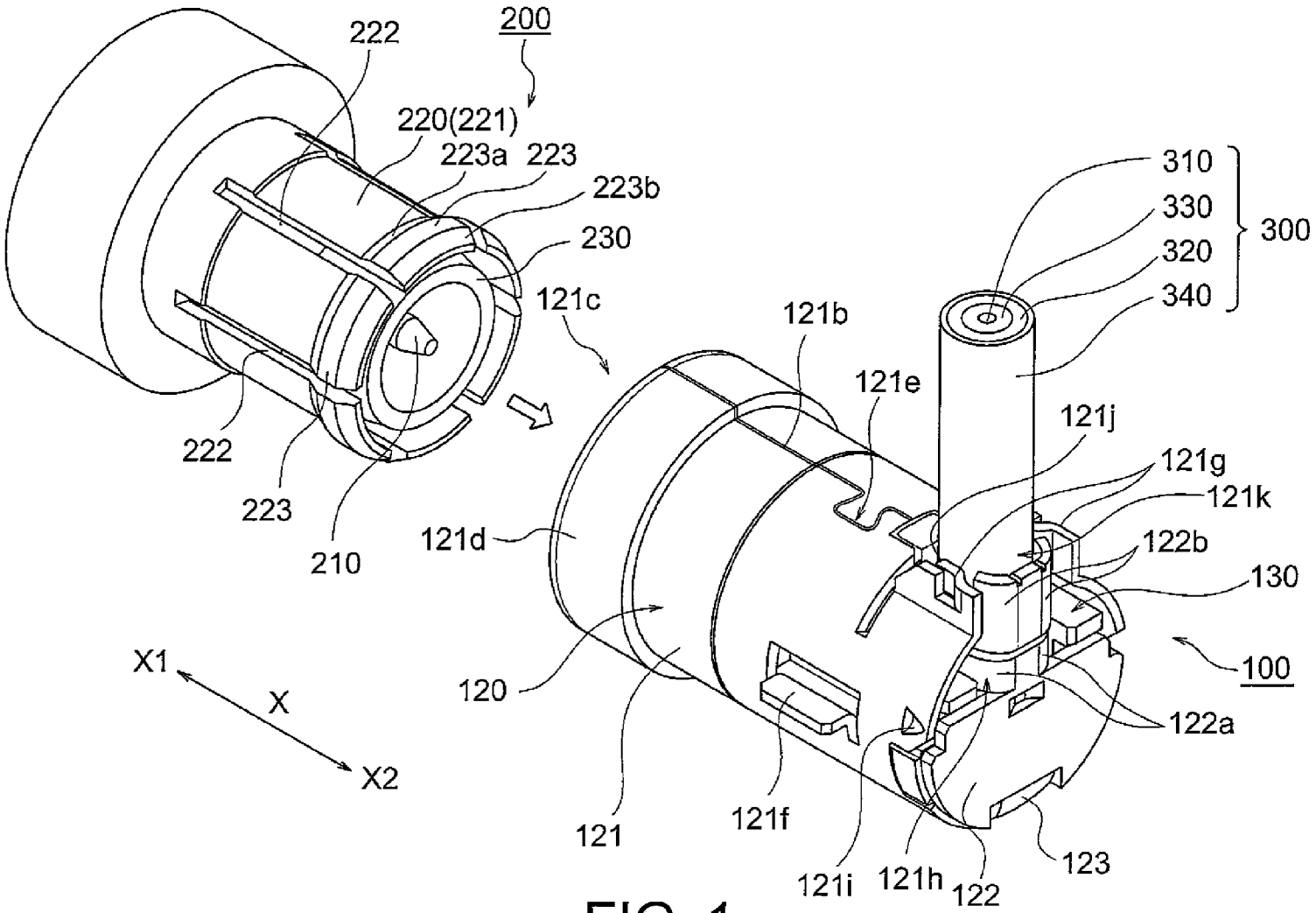
FIG. 1 is a perspective view showing a connector unit according to an embodiment of this invention.

In this embodiment, as shown in FIG. 1 etc., the connector unit comprises a connector 100 and a mating connector 200.

The connector 100 is a coaxial connector which is adapted to be attached to an end portion of a coaxial cable 300 for use in signal transmission, such as an antenna wire, thereby electrically connecting the coaxial cable 300 to the mating connector 200 inserted into the connector 100.

The connector 100 is formed as an MCX (micro coaxial) connector which is a snap-on/pull-off mating miniature connector.

Figure 9:
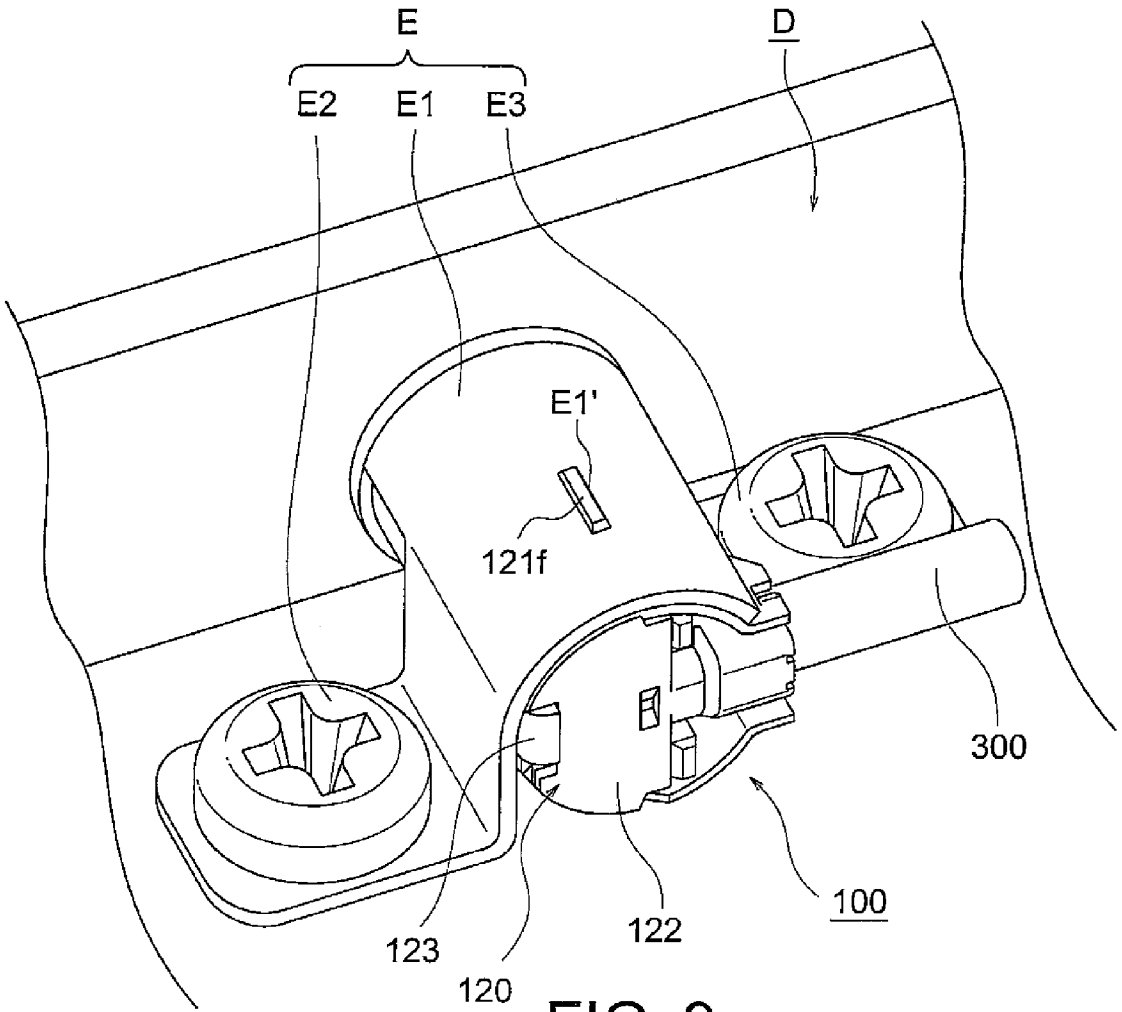
FIG. 9 is a using state diagram showing a state where the connector is mounted on a device.
Figure 10:
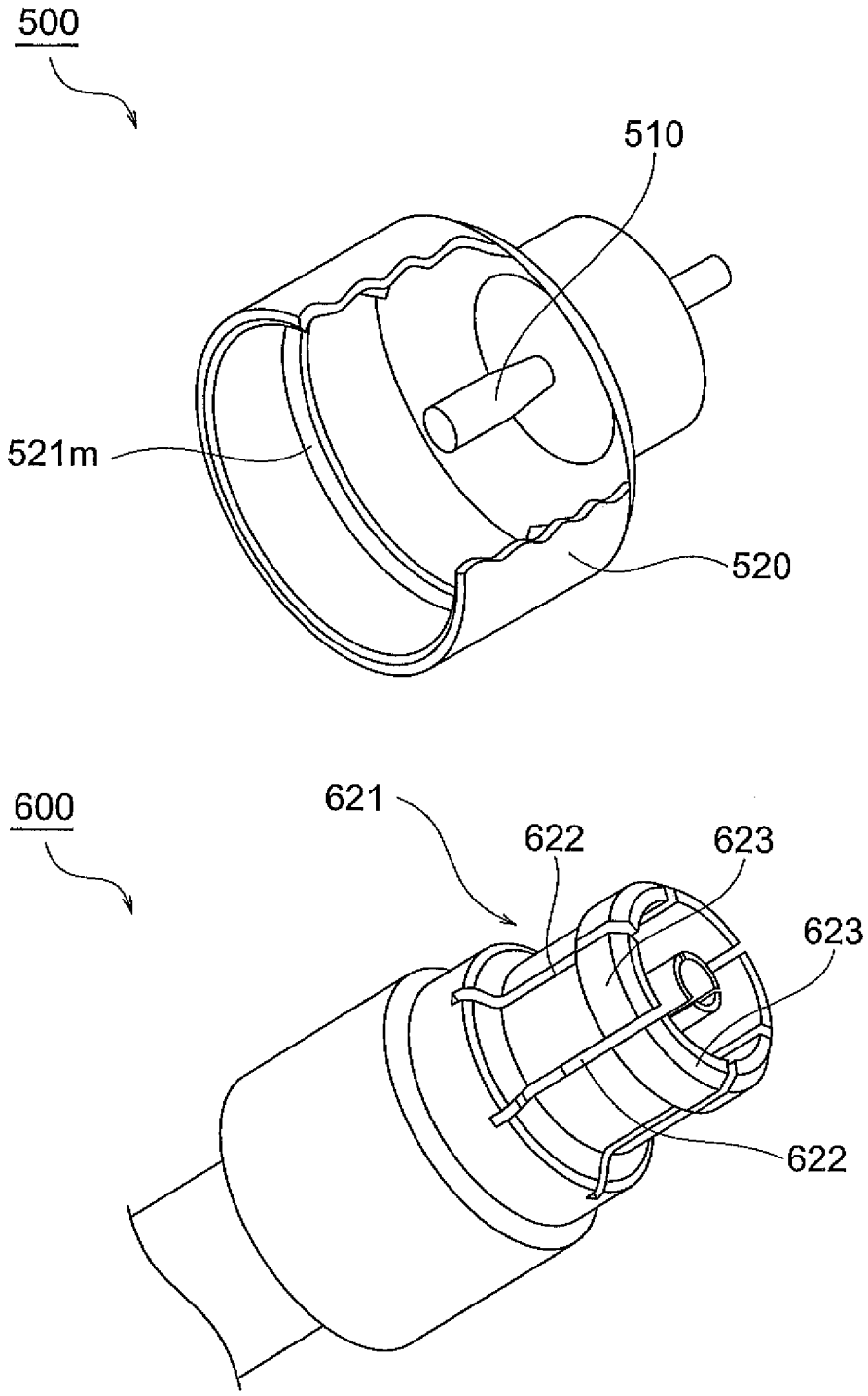
FIG. 10 is a perspective view showing a conventional coaxial connector and coaxial adapter.

As shown in FIG. 9, the connector 100 is adapted to be mounted on a device D as a mounting object by means of a mounting member group E. The mounting member group E comprises a mounting member E1 and screws E2 and E3 for fixing the mounting member E1 to the device D.

Figure 5:
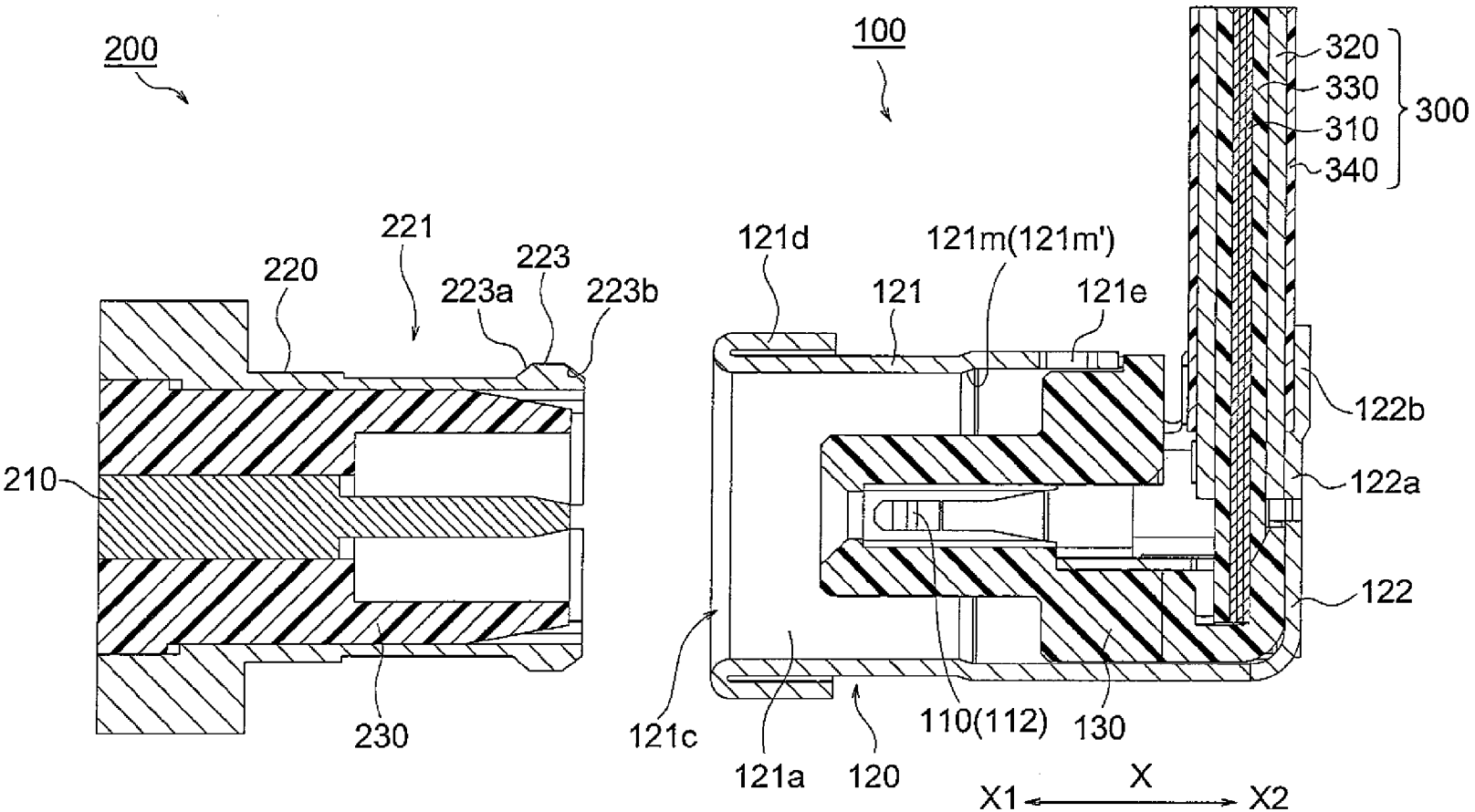
FIG. 5 is a cross-sectional view showing a state before inserting a mating connector into the connector.
Figure 7:
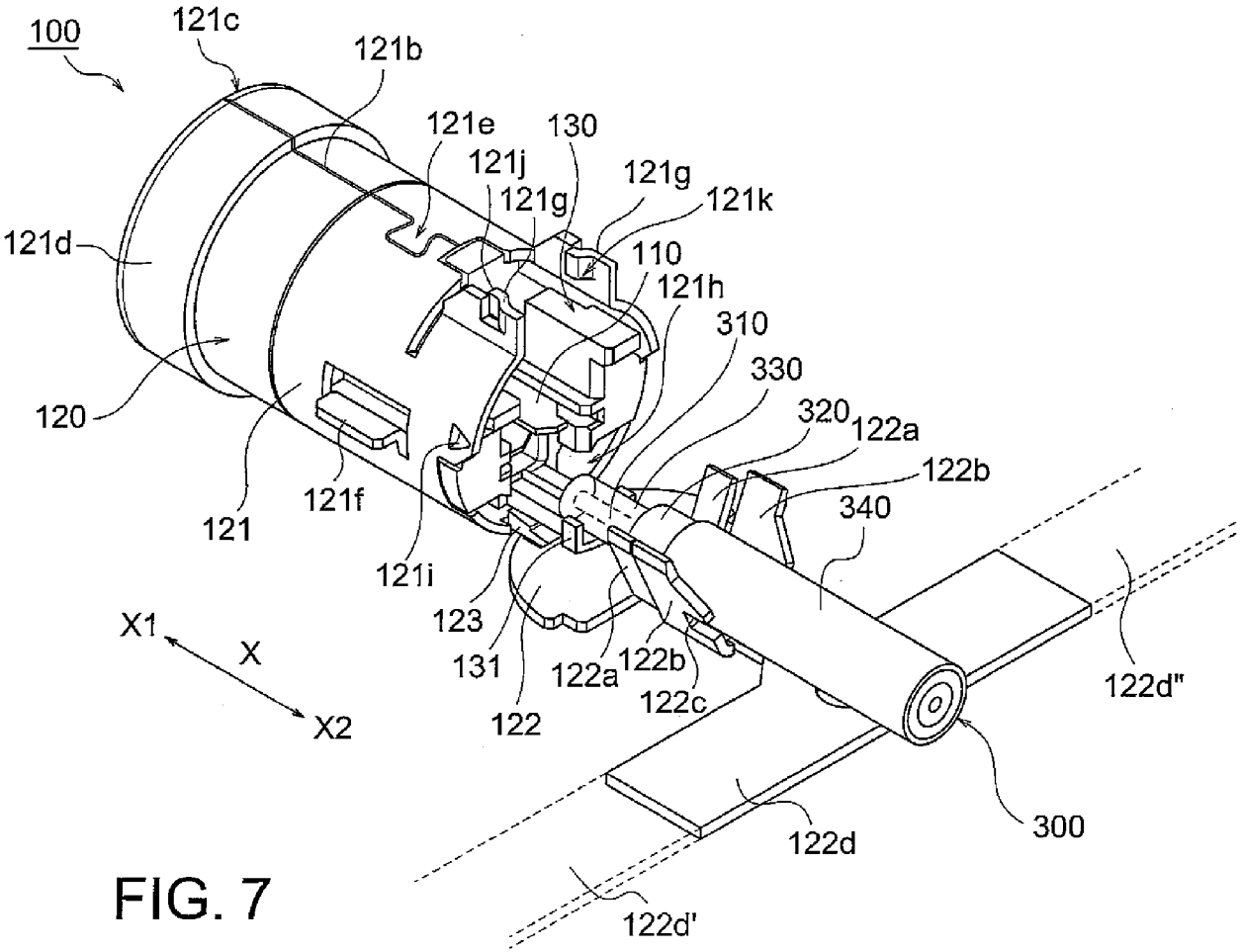
FIG. 7 is a perspective view showing a state where a coaxial cable is placed on press-holding pieces so as to be ready to be held under pressure by the press-holding pieces.

As shown in FIGS. 1, 5, 7, etc., the connector 100 comprises a conductive contact 110, a conductive shell 120, and an insulator 130.

Figure 6:
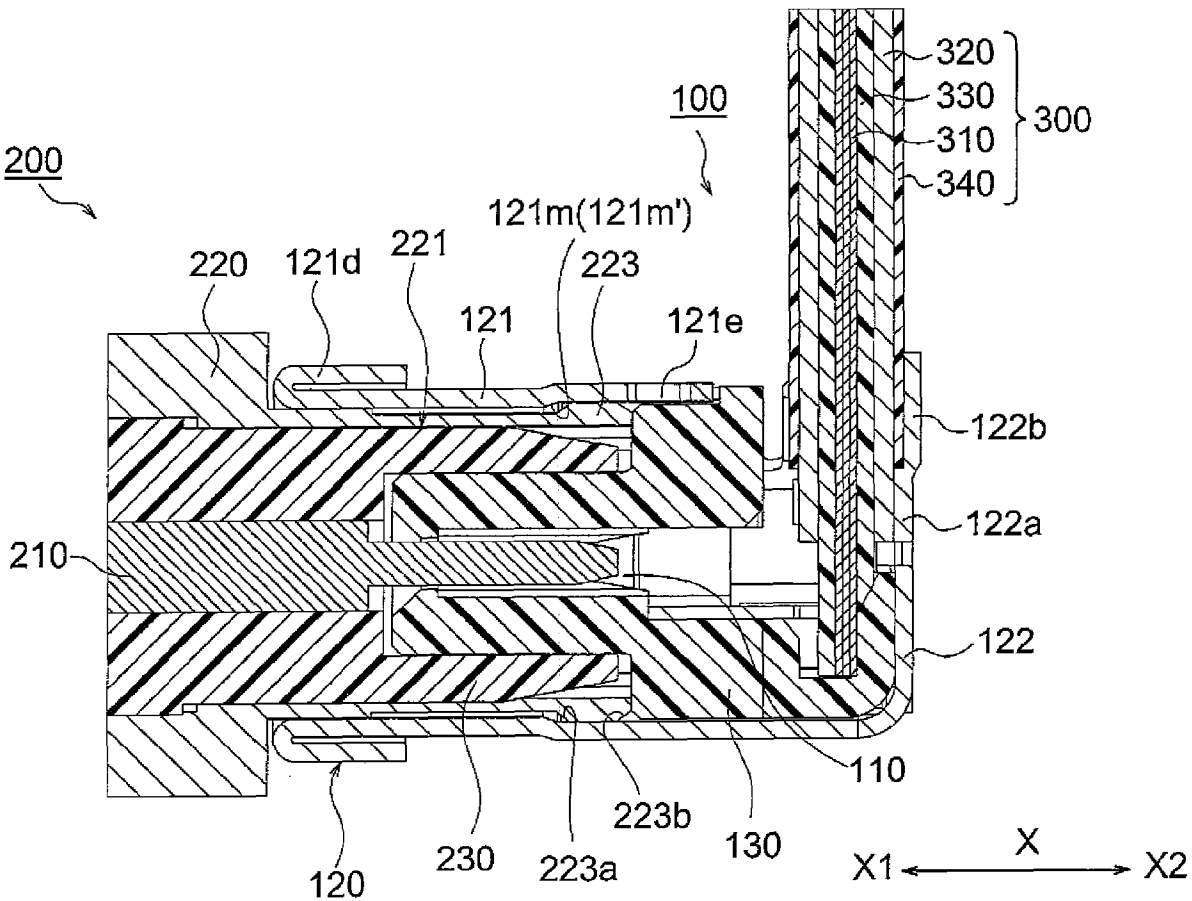
FIG. 6 is a cross-sectional view showing a state after inserting the mating connector into the connector.

The contact 110 is made of a copper alloy. As shown in FIGS. 6, 7, etc., the contact 110 is adapted to be connected to an inner conductor 310 of the coaxial cable 300 and to a mating contact 210 of the mating connector 200.

Figure 3:
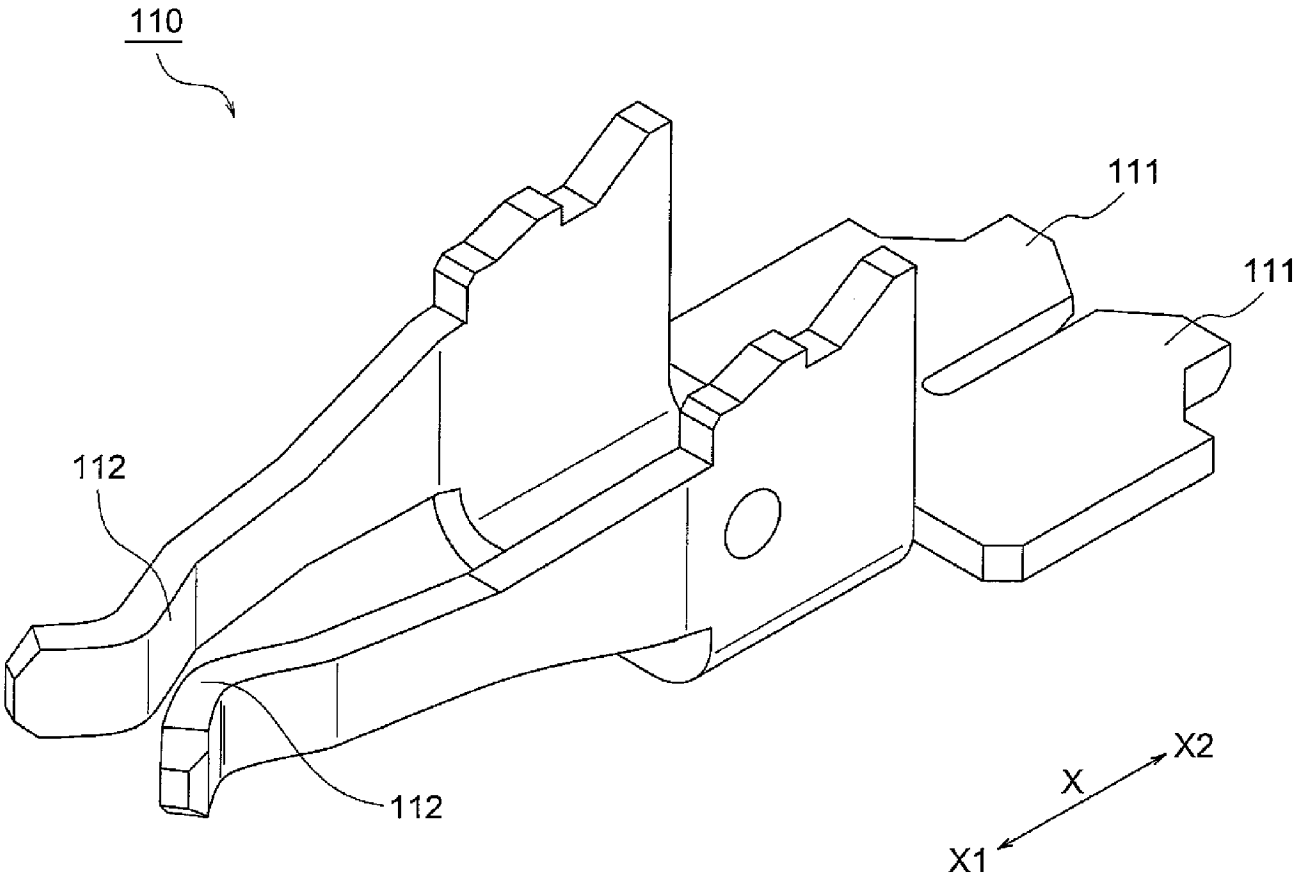
FIG. 3 is a perspective view showing a contact.

As shown in FIG. 3 etc., the contact 110 has a pair of pressure contact portions 111 formed on the deep side or the forward side X2 of a connector insertion direction X and adapted to receive therebetween the inner conductor 310 of the coaxial cable 300, and a pair of holding portions 112 formed on the rearward side X1 of the connector insertion direction X and adapted to receive and grasp therebetween the mating contact 210 of the mating connector 200.

The shell 120 is made of a copper alloy. As shown in FIGS. 6, 7, etc., the shell 120 accommodates therein the contact 110 and the insulator 130 and is adapted to be connected to an outer conductor 320 of the coaxial cable 300 and to a mating shell 220 of the mating connector 200.

The shell 120 integrally comprises a shell body portion 121, a shell pivotal portion 122, and a shell coupling portion 123.

The shell body portion 121 is formed by bending a copper-alloy metal plate into a hollow cylindrical shape or a circular tubular shape and, in this embodiment, is designed to have a length of about 7 mm in the connector insertion direction X (shell longitudinal direction).

The shell body portion 121 has an accommodation space 121*a*, a slit portion 121*b*, an insertion opening 121*c*, a shell folded-back portion 121*d*, a shell joining portion 121*e*, a pair of mounting projecting portions 121*f*, a pair of collar portions 121*g*, a shell pivotal portion side opening 121*h*, a pair of insulator locking or engaging portions 121*i*, a pair of shell pivotal portion engaging portions 121*j*, a cable lead-out portion 121*k*, and a locking portion 121*m*.

Figure 8:
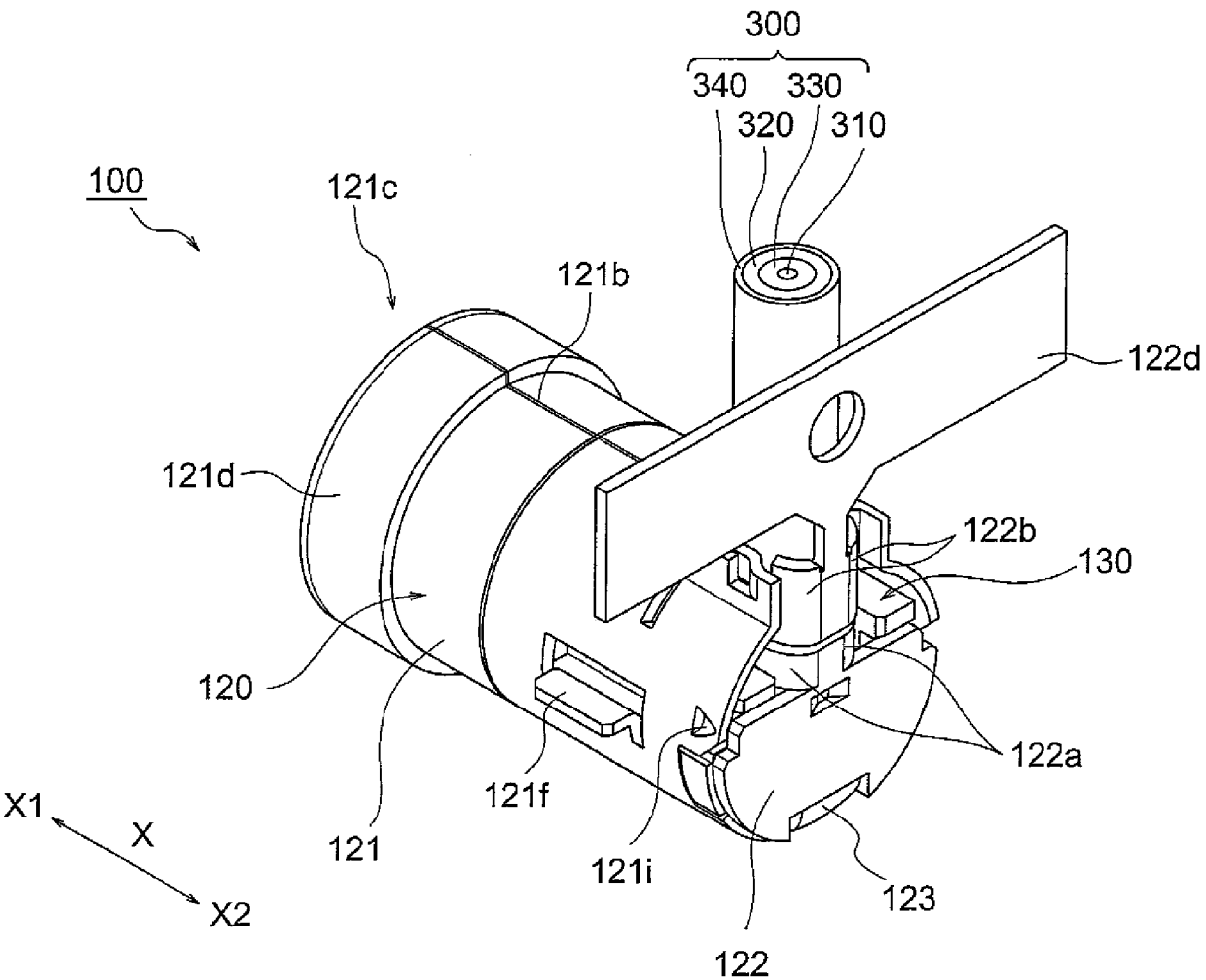
FIG. 8 is a perspective view showing a state where a shell coupling portion is bent in the state of FIG. 7 after the coaxial cable is held under pressure by the press-holding pieces.

As shown in FIG. 7 etc., the accommodation space 121*a* accommodates therein the contact 110 and the insulator 130 in the state where the shell pivotal portion 122 is not fixed to the shell body portion 121. On the other hand, as shown in FIGS. 1 and 8, in the state where the shell pivotal portion 122 is fixed to the shell body portion 121, the accommodation space 121*a* accommodates therein, in addition to the contact 110 and the insulator 130, press-holding pieces 122*a* and 122*b* of the shell pivotal portion 122, one end portion of the coaxial cable 300, and so on. Further, as shown in FIG. 6, the accommodation space 121*a* accommodates therein the front side of the mating connector 200 in the state where the mating connector 200 is inserted into the connector 100.

Figure 4:
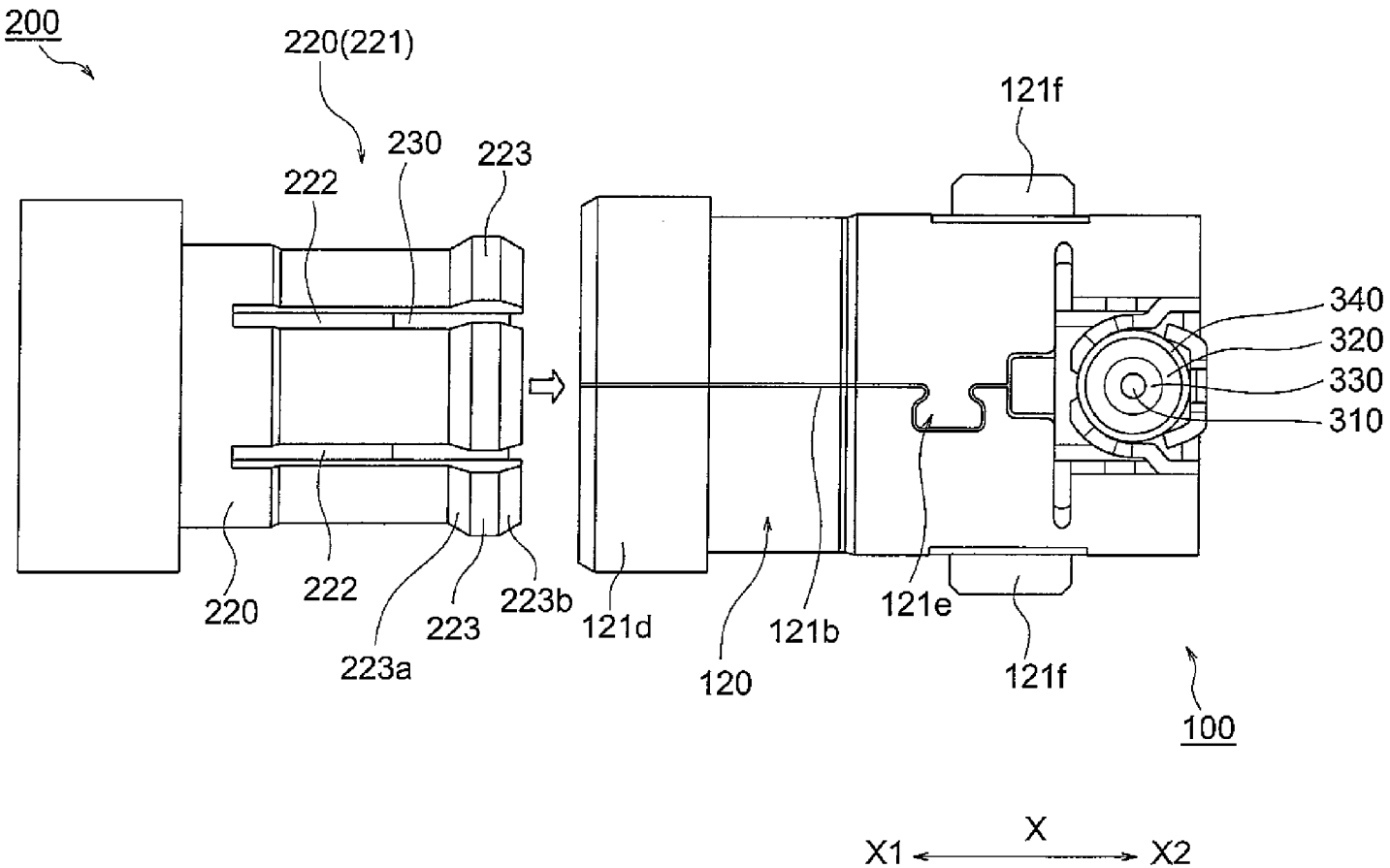
FIG. 4 is a plan view showing the connector unit.

As shown in FIGS. 1, 4, etc., the shell body portion 121 is formed with the slit portion 121*b* which extends parallel to the axis of the shell body portion 121 over its entire region in the connector insertion direction X. The slit portion 121*b* serves to expand, i.e. increase the diameter of, the insertion opening 121*c* of the shell body portion 121 upon insertion of the mating connector 200 into the connector 100, that is, serves to give elasticity or springiness in terms of the shape to the shell body portion 121, thereby facilitating the insertion of the mating connector 200.

Figure 2:
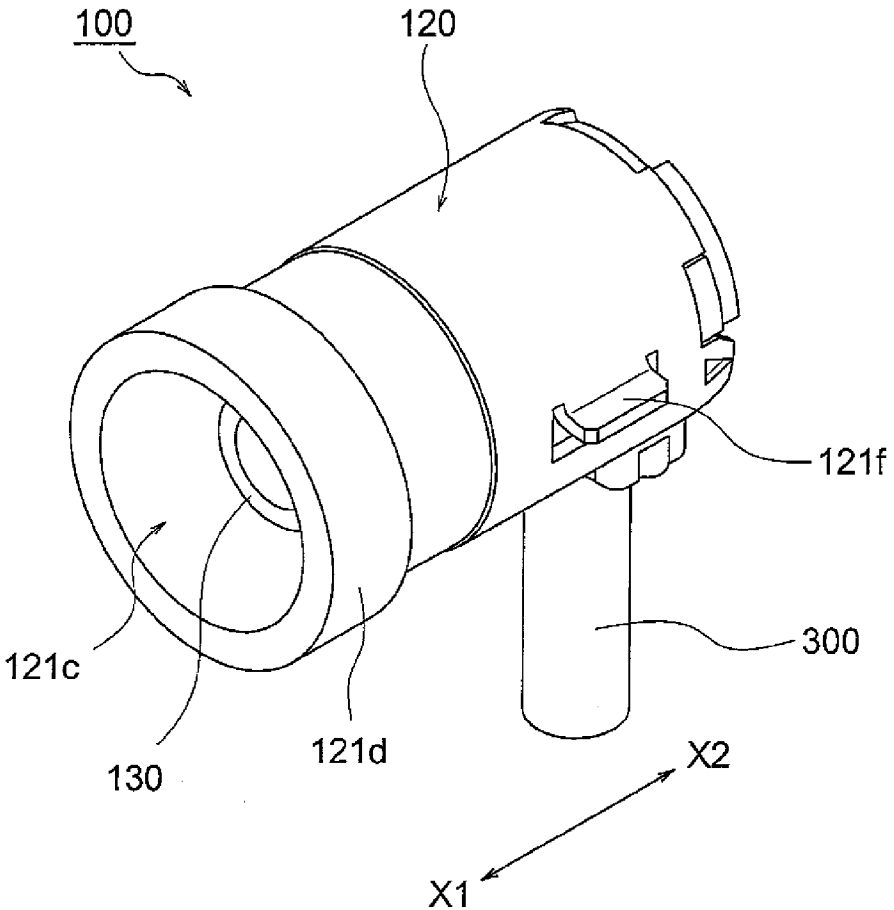
FIG. 2 is a perspective view showing a connector.

As shown in FIGS. 2, 5, etc., the insertion opening 121*c* is formed at one end, in the connector insertion direction X, of the shell body portion 121 for allowing the mating connector 200 to be inserted thereinto.

As shown in FIGS. 1, 5, etc., the shell folded-back portion 121*d* is formed by folding back an end portion, on the insertion opening 121*c* side, of the shell body portion 121 to its outer periphery side toward the forward side X2 of the connector insertion direction X.

As shown in FIGS. 1, 4, etc., the shell joining portion 121*e* serves to fixedly join together, by engagement, opposed portions of the shell body portion 121 divided by the slit portion 121*b*. As shown in FIG. 5, the shell joining portion 121*e* is formed at a position more on the forward side X2 of the connector insertion direction X than a position of the locking portion 121*m* in the connector insertion direction X. Although the single shell joining portion 121*e* is provided in this embodiment, a plurality of shell joining portions 121*e* may be provided.

As shown in FIGS. 1, 2, etc., the mounting projecting portions 121*f* are formed to project outward from an outer periphery of the shell body portion 121 and are used when mounting the connector 100 on the device D as the mounting object. The mounting projecting portions 121*f* are each formed at a position more on the forward side X2 of the connector insertion direction X than the position of the locking portion 121*m* in the connector insertion direction X. As shown in FIG. 9, the mounting projecting portions 121*f* are respectively inserted into a mounting hole (not illustrated) formed in the device D and into a mounting hole E1' formed in the mounting member E1 of the mounting member group E.

The collar portions 121*g* are formed to project outward from the outer periphery of the shell body portion 121 and, as shown in FIG. 1 etc., are located around the press-holding pieces 122*b* and the coaxial cable 300 so as to be in contact with the press-holding pieces 122*b* in the state where the shell pivotal portion 122 is fixed to the shell body portion 121. With this configuration, it is possible to prevent the press-holding pieces 122*b* grasping the coaxial cable 300 from opening and thus to suppress a reduction in contact reliability between the outer conductor 320 of the coaxial cable 300 and the shell 120. In this embodiment, as described above, it is configured such that the collar portions 121*g* are located around the press-holding pieces 122*b* so as to be in contact with the press-holding pieces 122*b*. Alternatively, it may be configured such that the collar portions 121*g* are located around the press-holding pieces 122*b* so as to press the press-holding pieces 122*b*. In this case, stronger cable retention can be obtained. However, neither configuration is essential. For example, the collar portions 121*g* may be spaced apart from the press-holding pieces 122*b*.

As shown in FIGS. 1, 7, etc., the shell pivotal portion side opening 121*h* is an opening formed at the other end, in the connector insertion direction X, of the shell body portion 121.

As shown in FIGS. 1, 7, etc., the insulator locking portions 121*i* engage with the insulator 130 to fix the insulator 130 to the shell body portion 121, thereby preventing coming-off of the insulator 130.

As shown in FIG. 1 etc., the shell pivotal portion engaging portions 121*j* engage with engaging portions 122*c* of the shell pivotal portion 122 in the state where the shell coupling portion 123 is bent (i.e. the shell pivotal portion 122 is pivoted), thereby fixing the shell pivotal portion 122 to the shell body portion 121.

As shown in FIGS. 1, 7, etc., the cable lead-out portion 121*k* is an opening formed in the vicinity of the collar portions 121*g* for leading out the coaxial cable 300 from the shell 120.

As shown in FIGS. 5 and 6, the locking portion 121*m* is formed on the inner periphery side of the shell body portion 121 and, in the state where front end side convex portions 223 of the mating connector 200 are received in the accommodation space 121*a* at a position more on the forward side X2 of the connector insertion direction X than the position of the locking portion 121*m*, the locking portion 121*m* serves to prohibit the front end side convex portions 223 from moving toward the rearward side X1 of the connector insertion direction X. Specifically, as shown in FIGS. 5 and 6, the locking portion 121*m* is a stepped portion which is formed annular on an inner periphery of the shell body portion 121 and which is inclined in a direction from the inner periphery side to the outer periphery side of the shell body portion 121 from the rearward side X1 toward the forward side X2 of the connector insertion direction X. This stepped portion as the locking portion 121*m* is formed by deforming the shell body portion 121 so as to displace in the direction from the inner periphery side to the outer periphery side of the shell body portion 121 from the rearward side X1 toward the forward side X2 of the connector insertion direction X. The locking portion 121*m* has a tapered inclined inner surface 121*m*' which increases its diameter from the rearward side X1 toward the forward side X2 of the connector insertion direction X. In this embodiment, as described above, the locking portion 121*m* is configured as the stepped portion formed on the inner periphery of the shell body portion 121. However, a specific configuration of the locking portion 121*m* is not limited to the stepped portion and may be, for example, a projecting portion that projects inward from the inner periphery of the shell body portion 121.

As shown in FIG. 1 etc., the shell pivotal portion 122 is provided so as to be pivotable with respect to the shell body portion 121 and, in the state where the shell pivotal portion 122 is fixed to the shell body portion 121, the shell pivotal portion 122, along with the shell body portion 121, serves as a housing of the connector 100. An outer side surface of the shell pivotal portion 122, i.e. a side surface, which is in contact with a placement surface in the state shown in FIG. 7, of the shell pivotal portion 122, is formed flat.

As shown in FIG. 1 etc., the shell pivotal portion 122 has the pair of press-holding pieces 122*a*, the pair of press-holding pieces 122*b*, and the pair of engaging portions 122*c*.

As shown in FIG. 1 etc., the press-holding pieces 122*a* grasp the outer conductor 320 of the coaxial cable 300 under pressure. By the contact between the press-holding pieces 122*a* and the outer conductor 320, the connection between the shell 120 and the outer conductor 320 is established. The press-holding pieces 122*a* are formed in such a size as to be received in the shell pivotal portion side opening 121*h* of the shell body portion 121 in the state where the press-holding pieces 122*a* grasp the coaxial cable 300.

As shown in FIG. 1 etc., the press-holding pieces 122*b* grasp an outer jacket 340 of the coaxial cable 300 under pressure. Although, in this embodiment, the outer jacket 340 is grasped using the press-holding pieces 122*b* as described above, the provision of the press-holding pieces 122*b* is not essential. When the press-holding pieces 122*b* are not provided, a means for fixing the outer jacket 340 may be separately provided.

In FIGS. 7 and 8, symbols 122*d*, 122*d*', and 122*d*" each denote a carrier integrally formed with the shell pivotal portion 122. The carrier is snapped off and removed upon attaching the coaxial cable 300 to the connector 100.

As shown in FIG. 1, the shell coupling portion 123 is formed to be bendable and couples together the shell body portion 121 and the shell pivotal portion 122.

The term "bendable" referred to in this invention represents that the bending motion is enabled once or more, and is not limited to meaning that the bending motion is permanently enabled.

In this embodiment, the shell body portion 121 and the shell pivotal portion 122 are coupled together by the shell coupling portion 123 formed therebetween and the shell body portion 121, the shell pivotal portion 122, and the shell coupling portion 123 are integrally formed together. However, the shell body portion 121 and the shell pivotal portion 122 may be separately formed from each other and may be, for example, hinged together so as to be mutually pivotable.

The insulator 130 is made of synthetic resin and, as shown in FIGS. 5, 7, etc., the insulator 130 holds the contact 110, is fixedly accommodated in the accommodation space 121*a* of the shell 120, and is interposed between the contact 110 and the shell 120.

As shown in FIG. 7 etc., the insulator 130 has a tray portion 131 disposed on the shell coupling portion 123.

As shown in FIG. 7 etc., in the state where the coaxial cable 300 is placed on the shell pivotal portion 122, the tray portion 131 receives an insulator 330 of the coaxial cable 300, thereby positioning the insulator 330 and the inner conductor 310 of the coaxial cable 300. Upon bending the shell coupling portion 123 (i.e. pivoting the shell pivotal portion 122), the tray portion 131 is bent along with the shell coupling portion 123.

The mating connector 200 is adapted to be inserted into the connector 100 so as to be electrically connected to the connector 100 and thus to the coaxial cable 300.

As shown in FIGS. 1 and 5, the mating connector 200 comprises the conductive mating contact 210, the conductive mating shell 220, and a mating insulator 230.

The mating contact 210 is made of a copper alloy and, as shown in FIG. 6, is adapted to be connected to the contact 110 of the connector 100. As shown in FIGS. 1 and 5, the mating contact 210 is held on the inner periphery side of the mating insulator 230. An end portion, on the forward side X2 of the connector insertion direction X, of the mating contact 210 is formed in a tapered shape that reduces its diameter toward the forward side X2 of the connector insertion direction X.

The mating shell 220 is made of a copper alloy and, as shown in FIG. 6 etc., is disposed on the outer periphery side of the mating insulator 230 to hold the mating insulator 230.

The mating shell 220 has a tubular portion 221, a plurality of slit portions 222, and the front end side convex portions 223.

As shown in FIGS. 1, 5, etc., the tubular portion 221 is formed on the forward side X2 of the connector insertion direction X of the mating shell 220 and has a hollow cylindrical shape or a circular tubular shape.

As shown in FIGS. 1 and 4, the slit portions 222 are formed in the tubular portion 221 to give elasticity or springiness to the front end side of the tubular portion 221.

As shown in FIGS. 1, 4, etc., the front end side convex portions 223 are formed on the front end side of the tubular portion 221 and project outward from an outer periphery of the tubular portion 221. As shown in FIG. 6, in the state where the mating connector 200 is inserted into the connector 100, the front end side convex portions 223 are received in the accommodation space 121*a* at the position more on the forward side X2 of the connector insertion direction X than the position of the locking portion 121*m*. As shown in FIGS. 1, 4, etc., the front end side convex portions 223 have tapered rearward-side outer surfaces 223*a* formed on the rearward side X1 of the connector insertion direction X and inclined radially outward (i.e. increasing the diameter thereof) toward the forward side X2 of the connector insertion direction X and tapered forward-side outer surfaces 223*b* formed on the forward side X2 of the connector insertion direction X and inclined radially inward (i.e. reducing the diameter thereof) toward the forward side X2 of the connector insertion direction X. The outer diameter of the front end side convex portions 223 is set slightly larger than the inner diameter of the insertion opening 121*c*, the inner diameter of the accommodation space 121*a* at a position more on the rearward side X1 of the connector insertion direction X than the position of the locking portion 121*m*, and the inner diameter of the accommodation space 121*a* at a position more on the forward side X2 of the connector insertion direction X than the position of the locking portion 121*m*.

The mating insulator 230 is made of synthetic resin and, as shown in FIGS. 1, 5, etc., the mating insulator 230 holds the mating contact 210 on its inner periphery side, is fixedly accommodated on the inner periphery side of the mating shell 220, and is interposed between the mating contact 210 and the mating shell 220.

As shown in FIG. 1 etc., the coaxial cable 300 comprises the inner conductor 310, the outer conductor 320 disposed around the inner conductor 310, the insulator 330 interposed between the inner conductor 310 and the outer conductor 320, and the outer jacket 340 covering an outer periphery of the outer conductor 320.

The inner conductor 310 of the coaxial cable 300 is adapted to be connected to the contact 110 of the connector 100 while the outer conductor 320 of the coaxial cable 300 is adapted to be connected to the shell 120 of the connector 100.

In this embodiment, the diameter of the coaxial cable 300 is set to about 1.32 mm.

The coaxial cable 300 can be smoothly bent at a portion other than a portion fixed by the press-holding pieces 122*a* and 122*b*, that is, at a portion located outside of the connector 100 in the state where the coaxial cable 300 has been attached to the connector 100 as shown in FIG. 1 etc.

Hereinbelow, referring to FIGS. 5 and 6, a description will be given of a method of attaching the mating connector 200 to the connector 100 and of the operations of the respective portions when attaching the mating connector 200 to the connector 100.

First, when an operator moves the mating connector 200, with its front end side convex portions 223 facing the shell 120 of the connector 100, toward the forward side X2 of the connector insertion direction X, the tubular portion 221 of the mating connector 200 enters the accommodation space 121*a* of the shell body portion 121 from the insertion opening 121*c* so that the slit gap of the slit portion 121*b* is expanded to increase the diameter of the insertion opening 121*c* and simultaneously that the tubular portion 221 of the mating connector 200 is elastically deformed to reduce its diameter. In this event, since the forward-side outer surfaces 223*b* that are inclined radially inward toward the forward side X2 of the connector insertion direction X are formed on the forward side X2 of the connector insertion direction X of the front end side convex portions 223 and further since the shell folded-back portion 121*d* is formed at the end, on the insertion opening 121*c* side, of the shell body portion 121, the insertion opening 121*c* smoothly increases its diameter and simultaneously the tubular portion 221 of the mating connector 200 is elastically deformed smoothly to reduce its diameter.

Then, when the operator further pushes forward the mating connector 200 toward the forward side X2 of the connector insertion direction X, the forward end of the mating contact 210 enters between the pair of holding portions 112 of the contact 110. In this event, since the end portion, on the forward side X2 of the connector insertion direction X, of the mating contact 210 is formed in the tapered shape that reduces its diameter toward the forward side X2 of the connector insertion direction X, it smoothly enters between the pair of holding portions 112 of the contact 110.

Then, when the operator further pushes forward the mating connector 200 toward the forward side X2 of the connector insertion direction X, the front end side convex portions 223 of the mating connector 200 pass the locking portion 121*m* and enter the accommodation space 121*a* at the position more on the forward side X2 of the connector insertion direction X than the position of the locking portion 121*m*.

Hereinbelow, referring to FIGS. 5 and 6, a description will be given of a method of removing the mating connector 200 from the connector 100 and of the operations of the respective portions when removing the mating connector 200 from the connector 100.

First, when the operator moves the mating connector 200 toward the rearward side X1 of the connector insertion direction X, the front end side convex portions 223 enter the accommodation space 121*a* at the position more on the rearward side X1 of the connector insertion direction X than the position of the locking portion 121*m* so that the slit gap of the slit portion 121*b* is expanded and simultaneously that the tubular portion 221 of the mating connector 200 is elastically deformed to reduce its diameter. In this event, since the rearward-side outer surfaces 223*a* that are inclined radially inward toward the rearward side X1 of the connector insertion direction X are formed on the rearward side X1 of the connector insertion direction X of the front end side convex portions 223 and further since the locking portion 121*m* is formed with the tapered inclined inner surface 121*m*' which increases its diameter toward the forward side X2 of the connector insertion direction X, the slit gap of the slit portion 121*b* is smoothly expanded and simultaneously the tubular portion 221 of the mating connector 200 is elastically deformed smoothly to reduce its diameter.

Then, when the operator further moves the mating connector 200 toward the rearward side X1 of the connector insertion direction X, the mating contact 210 slips out of the pair of holding portions 112 of the contact 110.

Then, when the operator further moves the mating connector 200 toward the rearward side X1 of the connector insertion direction X, the front end side convex portions 223 pass the insertion opening 121*c* so that the mating connector 200 can be pulled out of the connector 100. In this event, the shell body portion 121 expanded by the front end side convex portions 223 is elastically restored so that the slit gap of the slit portion 121*b* returns to the normal magnitude of the gap with no force applied thereto, while the tubular portion 221 of the mating connector 200 is elastically restored to increase its diameter.

According to the connector unit of this embodiment thus obtained, the expandable slit portion 121*b* is formed in the shell body portion 121 to thereby give the springiness in terms of the shape to the shell body portion 121 on its insertion opening 121*c* side. As a consequence, when inserting the mating connector 200 into the connector 100, the shell body portion 121 is elastically deformed to increase its diameter on the insertion opening 121*c* side and, therefore, the mating connector 200 can be smoothly inserted into the connector 100 and thus the life of insertion and removal between the connector 100 and the mating connector 200 can be improved.

The shell body portion 121 can be formed by bending the metal plate and thus it is possible to achieve the springiness in terms of the material and to reduce the cost.

Since the connector 100 has the locking portion 121*m* that serves to prohibit the front end side convex portions 223 of the mating connector 200 from moving toward the rearward side X1 of the connector insertion direction X, it is possible to obtain a sufficient fitting force.

Since the locking portion 121*m* is simple in structure, i.e. is in the form of the stepped portion which is formed by deforming the shell body portion 121 so as to displace in the direction from its inner periphery side to its outer periphery side from the rearward side X1 toward the forward side X2 of the connector insertion direction X, it is possible to suppress an increase in manufacturing load caused by providing the locking portion 121*m*.

Since the shell 120 has the shell folded-back portion 121*d*, it is possible to improve the strength of the shell body portion 121 on its insertion opening 121*c* side and further to realize smooth insertion of the mating connector 200 into the insertion opening 121*c*. Further, since the shell folded-back portion 121*d* has the simple structure in which the end portion, on the insertion opening 121*c* side, of the shell body portion 121 is folded back to its outer periphery side toward the forward side X2 of the connector insertion direction X, it is possible to suppress an increase in manufacturing load caused by providing the shell folded-back portion 121*d*. Further, by adjusting the folding-back amount of the shell folded-back portion 121*d*, the springiness of the shell 120 can also be adjusted.

Since the mounting projecting portions 121*f* for use in mounting the connector 100 on the device D as the mounting object are each formed at the position more on the forward side X2 of the connector insertion direction X than the position of the locking portion 121*m*, it is possible to prevent the elastic deformation of the shell body portion 121 due to the insertion of the mating connector 200 from affecting the mounting projecting portions 121*f*.

Since the shell joining portion 121*e* fixedly joins together, by engagement, the opposed portions of the shell body portion 121 divided by the slit portion 121*b*, there is no possibility of the slit portion 121*b* being largely opened to cause the mating connector 200 to accidentally slip out.

What is claimed is:

1. A connector comprising a contact and a shell disposed around the contact, wherein the shell comprises:

a tubular shell body portion having a slit portion formed to extend over its entire region in a connector insertion direction;

an insertion opening formed at one end of the shell body portion;

a locking portion provided on an inner periphery side of the shell body portion, the locking portion being formed annular in a circumferential direction of the shell body portion; and a shell joining portion formed at a position more on a forward side of the connector insertion direction than a position of the locking portion and joining together opposed portions of the shell body portion divided by the slit portion.

2. The connector according to claim 1, wherein the locking portion is a stepped portion which is formed on an inner periphery of the shell body portion and which is inclined in a direction from the inner periphery side to an outer periphery side of the shell body portion from a rearward side of the connector insertion direction toward the forward side of the connector insertion direction.

3. The connector according to claim 1, wherein the shell further comprises a shell folded-back portion formed by folding back an end portion, on an insertion opening side, of the shell body portion to an outer periphery side of the shell body portion toward the forward side of the connector insertion direction.

4. The connector according to claim 1, wherein the shell further comprises a mounting projecting portion formed at a position more on the forward side of the connector insertion direction than the position of the locking portion and projecting outward from an outer periphery of the shell body portion.

5. The connector according to claim 1, wherein the shell body portion has a circular tubular shape.

6. A connector unit comprising the connector according to claim 1 and a mating connector adapted to be attached to the connector, wherein the mating connector comprises:

a mating contact; and a mating shell disposed around the mating contact, and wherein the mating shell comprises:

a tubular portion; and a front end side convex portion formed on a front end side of the tubular portion and projecting outward from an outer periphery of the tubular portion, the front end side convex portion extending in a circumferential direction of the tubular portion.

7. The connector unit according to claim 6, wherein when the mating connector is attached to the connector, the front end side convex portion of the mating connector is locked by the locking portion of the connector.

* * * * *